US008863418B2

(12) United States Patent
Acker et al.

(10) Patent No.: US 8,863,418 B2
(45) Date of Patent: Oct. 21, 2014

(54) FOLDING DISPLAY UNIT WITH CENTRAL MEMBER

(75) Inventors: Nathaniel Hull Acker, Norwalk, CT (US); Edmond Kimting Fung, Norwalk, CT (US)

(73) Assignee: Inventive Media LLC, Norwalk, CT (US)

( * ) Notice: Subject to any disclaimer, the term of this patent is extended or adjusted under 35 U.S.C. 154(b) by 0 days.

(21) Appl. No.: 13/883,137

(22) PCT Filed: Nov. 1, 2011

(86) PCT No.: PCT/US2011/058771

§ 371 (c)(1), (2), (4) Date: May 2, 2013

(87) PCT Pub. No.: WO2012/061375

PCT Pub. Date: May 10, 2012

(65) Prior Publication Data

US 2013/0219760 A1 Aug. 29, 2013

Related U.S. Application Data

(60) Provisional application No. 61/410,491, filed on Nov. 5, 2010.

(51) Int. Cl.

| | |
|---|---|
| ***G09F 15/00*** | (2006.01) |
| ***G09F 1/06*** | (2006.01) |
| ***G09F 7/00*** | (2006.01) |

(52) U.S. Cl.

CPC *G09F 7/00* (2013.01); *G09F 1/065* (2013.01); *G09F 15/0062* (2013.01); *G09F 1/06* (2013.01)

USPC ..... 40/610

(58) Field of Classification Search

CPC ... G09F 7/18; G09F 15/0068; G09F 15/0025; G09F 1/065

USPC ..... 40/610

See application file for complete search history.

(56) References Cited

U.S. PATENT DOCUMENTS

| | | | |
|---|---|---|---|
| 2,113,288 | A | 4/1938 | Berger |
| 5,355,603 | A | 10/1994 | Luikkomen |

(Continued)

FOREIGN PATENT DOCUMENTS

| | | |
|---|---|---|
| ES | 2255857 | 7/2006 |
| FR | 2876261 | 4/2006 |
| WO | 2008132250 A1 | 11/2008 |

OTHER PUBLICATIONS

PCT Application No. PCT/US2011/058771, International Search Report and Written Opinion dated Dec. 28, 2011.

*Primary Examiner* — Charles A Fox
*Assistant Examiner* — Shin Kim
(74) *Attorney, Agent, or Firm* — Matthew J. Kinnier; Hoffman Warnick LLC

(57) ABSTRACT

A point of sale display is disclosed. A display unit according to an embodiment includes: a first display face; a second display face; and a foldable central member positioned between the first and second display faces, the foldable central member including: a foldable L-shaped member; and a transverse member positioned within a slot of the foldable L-shaped member, wherein the foldable central member automatically expands from a storage position to a display position, such that the first and second display faces form an opening therebetween.

12 Claims, 7 Drawing Sheets

(56) References Cited

U.S. PATENT DOCUMENTS

| | | | | |
|---|---|---|---|---|
| 5,454,180 | A | 10/1995 | Volpe | |
| 5,632,390 | A | 5/1997 | Podergois | |
| 5,966,857 | A | 10/1999 | Pettersson et al. | |
| 6,173,515 | B1 * | 1/2001 | Walsh | 40/124.08 |
| 6,347,772 | B1 | 2/2002 | L'Hotel | |
| 7,134,230 | B1 * | 11/2006 | Boens et al. | 40/610 |
| 7,143,230 | B2 | 11/2006 | Uchiyama et al. | |
| 7,159,350 | B2 | 1/2007 | L'Hotel | |
| 7,437,842 | B2 | 10/2008 | Sgambellone | |
| 7,520,071 | B2 | 4/2009 | Abramson | |
| 7,726,054 | B2 | 6/2010 | Mestres Armengol et al. | |
| 7,774,964 | B2 * | 8/2010 | L'Hotel | 40/539 |
| 8,099,883 | B2 * | 1/2012 | Mestres Armengol et al. | 40/124.07 |
| 8,590,188 | B2 * | 11/2013 | Mirsch | 40/610 |
| 2007/0245610 | A1 * | 10/2007 | Mestres Armengol et al. | 40/610 |
| 2007/0294925 | A1 * | 12/2007 | L'Hotel | 40/124.19 |
| 2008/0083146 | A1 * | 4/2008 | Martin Presa | 40/600 |
| 2010/0236117 | A1 * | 9/2010 | Mestres Armengol et al. | 40/610 |
| 2012/0227297 | A1 * | 9/2012 | Kawaguchi et al. | 40/610 |
| 2013/0219760 | A1 * | 8/2013 | Acker et al. | 40/610 |

* cited by examiner

FOLDING DISPLAY UNIT WITH CENTRAL MEMBER

This application claims priority to International Application PCT/US2011/058771, filed Nov. 1, 2011, entitled "FOLDING DISPLAY UNIT WITH CENTRAL MEMBER", which claims benefit to U.S. Provisional Application No. 61/410,491, both of which are incorporated by reference herein in their entirety.

TECHNICAL FIELD

Embodiments of this disclosure relate generally to advertising displays and, more particularly, to point of sale displays.

BACKGROUND

Point of sale displays are commonly used in retail environments, such as supermarkets, as well as trade shows, conventions, and the like. Advertising material is printed on display faces made of cardboard or plastic sheeting. The displays are kept in a storage or shipping state, so that the display can be laid flat and, subsequently, folded. When the display is at the "point of sale", the display may be deployed and opened. This open position also allows the display to be supported and displayed.

When the point of sale display is to be removed, the display may be collapsed back into the storage or shipping state.

BRIEF SUMMARY

A first aspect of the disclosure provides a display unit, comprising: a first display face; a second display face; and a foldable central member positioned between the first and second display faces, the foldable central member including: a foldable L-shaped member; and a transverse member positioned within a slot of the foldable L-shaped member, wherein the foldable central member automatically expands from a storage position to a display position, such that the first and second display faces form an opening therebetween.

These and other aspects, advantages and salient features of the invention will become apparent from the following detailed description, which, when taken in conjunction with the annexed drawings, where like parts are designated by like reference characters throughout the drawings, disclose embodiments of the invention.

BRIEF DESCRIPTION OF THE DRAWINGS

The above and other aspects, features and advantages of the invention will be better understood by reading the following more particular description of the invention in conjunction with the accompanying drawings.

Figure 1:
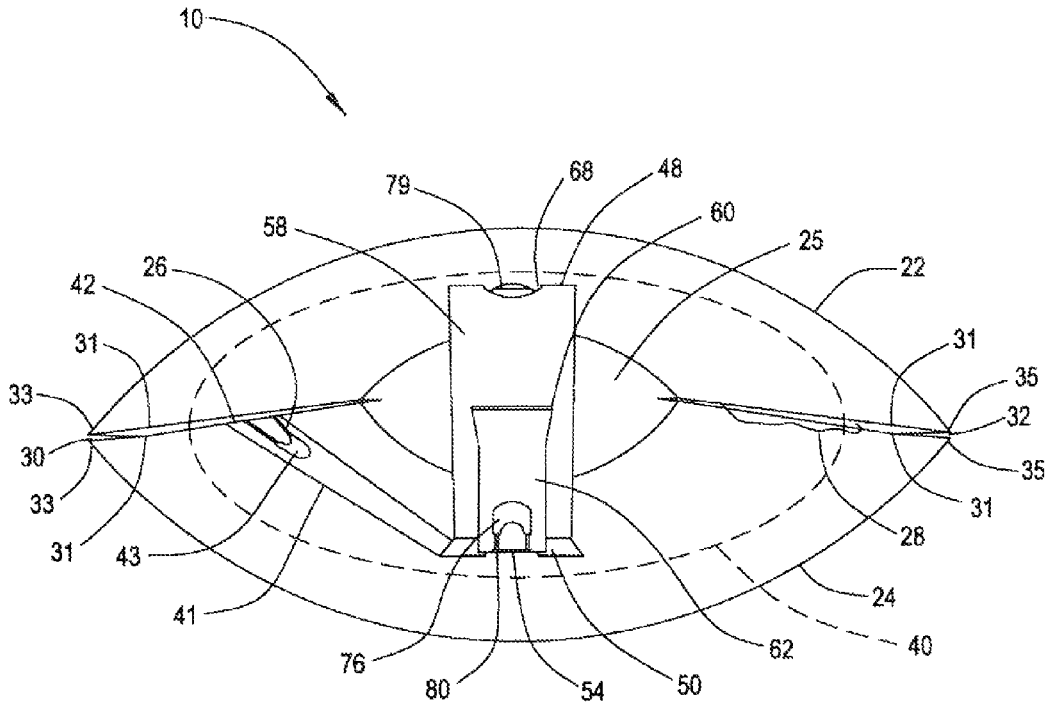
FIG. 1 shows a top view of a display unit according to embodiments of the invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

Point of sale displays are commonly used in retail environments, such as supermarkets, as well as trade shows, conventions, and the like. Advertising material is printed on display faces made of cardboard or plastic sheeting. The displays are kept in a storage or shipping state, in which the displays are flat, so that the displays are easily shipped. When the displays are at the "point of sale", the displays may be deployed and opened into the display position. This display position not only displays any advertising material on the face of the display, but also allows the display to be supported upright.

When the point of sale display is to be removed, the display may be collapsed back into the storage or shipping state.

Embodiments of the invention provide a display unit, comprising: a first display face; a second display face; and a foldable central member positioned between the first and second display faces, the foldable central member including: a foldable L-shaped member; and a transverse member positioned within a slot of the foldable L-shaped member, wherein the foldable central member automatically expands from a storage position to a display position, such that the first and second display faces form an opening therebetween. The foldable central member automatically expands once the display unit is unpacked, and requires no assembly of parts together. Consequently, the display unit, according to embodiments of the invention, is less complicated and more time efficient than conventional display units.

Turning now to FIG. 1, a top view of the display unit 10 in a display position is shown according to embodiments of the invention. The display unit 10 includes a first display face 22 and a second display face 24. A foldable central member 40 is positioned between the first and second display faces 22, 24. As will be described later herein, foldable central member 40 includes a foldable L-shaped member 61 (FIG. 4) and a transverse member 62 (FIG. 4). The foldable central member 40 expands, from a storage position (FIG. 3), to a display position, as shown in FIG. 1.

In the display position, in response to the expansion of the foldable central member 40, first and second display faces 22, 24 form an opening 25 therebetween. Although only one foldable central member 40 is shown, and described herein, it is understood that a plurality of foldable central members 40 may be positioned between the first and second display faces 22, 24. Further, although the opening 25 of the display unit 10 is shown to be substantially mandorla-like in shape, it is understood that opening 25 of display unit 10 may be any other shape, such as, but not limited to, a cylinder, or a quadrilateral.

Figure 2:
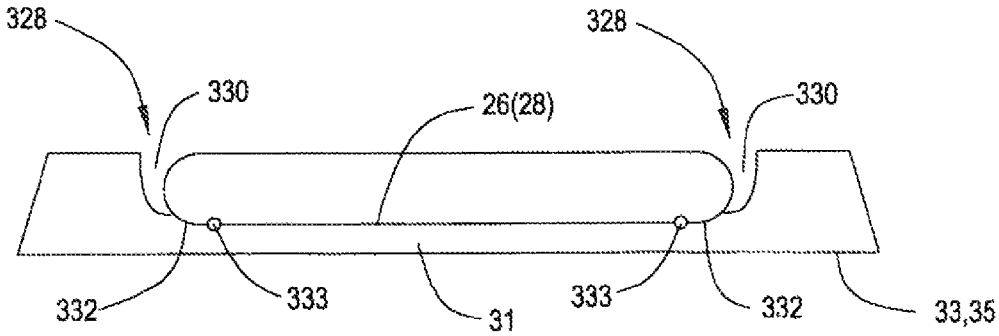
FIG. 2 shows a portion of a display face according to embodiments of the invention.

First and second display faces 22, 24, may be connected by a plurality of elastic bands 26, 28 to form a first end 30 of display unit 10 and a second end 32 of display unit 10. Turning now to FIG. 2, and with continued reference to FIG. 1, a portion of one of display faces 22, 24 is shown to describe the connection between first and second display faces 22, 24 according to embodiments of the invention. First and second display faces 22, 24 each include at least one pair of opposing tabs 31 at their respective edges 33, 35. Each tab 31 includes a pair of opposing slots 328. In one embodiment, slots 328 may include openings 330, slits 332, and holes 333 for accommodating elastic bands 26, 28. However, other slot formations capable of receiving an elastic band may be possible. When assembled, each tab 31 of first display face 22 extends inwardly and is adjacent to a tab 31 of second display face 24, such that slots 328 (e.g., openings 330, slits 332, and holes 333) of each tab 31 of first display face 22 substantially coincides with slots 328 (e.g., openings 330, slits 332, and holes 333) of each tab 31 of second display face 24. Elastic bands 26, 28 are stretched and hooked into slots 328 (e.g., openings 330, along slits 332, and into holes 333) to hold respective edges 33, 35 of each display face 22, 24 together and form ends 30, 32 of display unit 10. These flexible connections limit unwanted movement of first display face 22 with respect to second display face 24. Although one embodiment of forming ends 30, 32 of display unit 10 has been illustrated, display faces 22, 24 may be coupled in a variety of other ways, e.g., adhesive.

Figure 3:
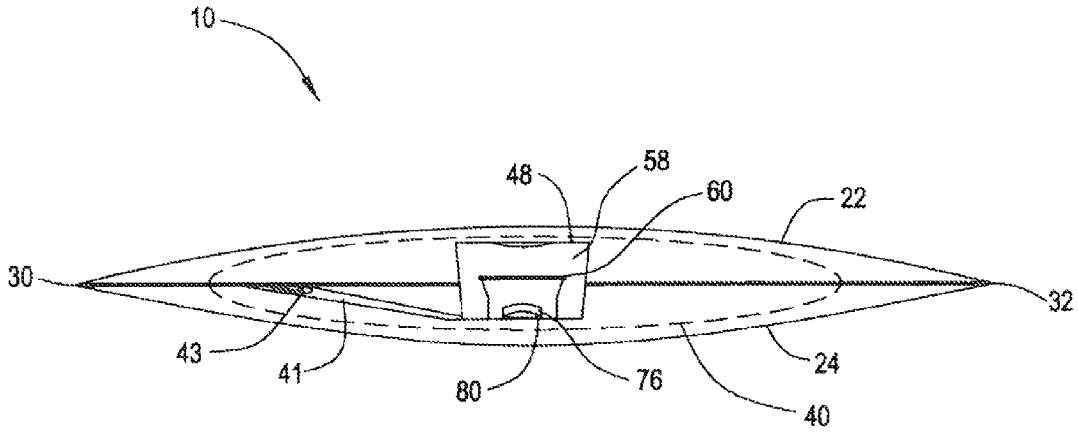
FIG. 3 shows a top view of a display unit according to embodiments of the invention.
Figure 4:
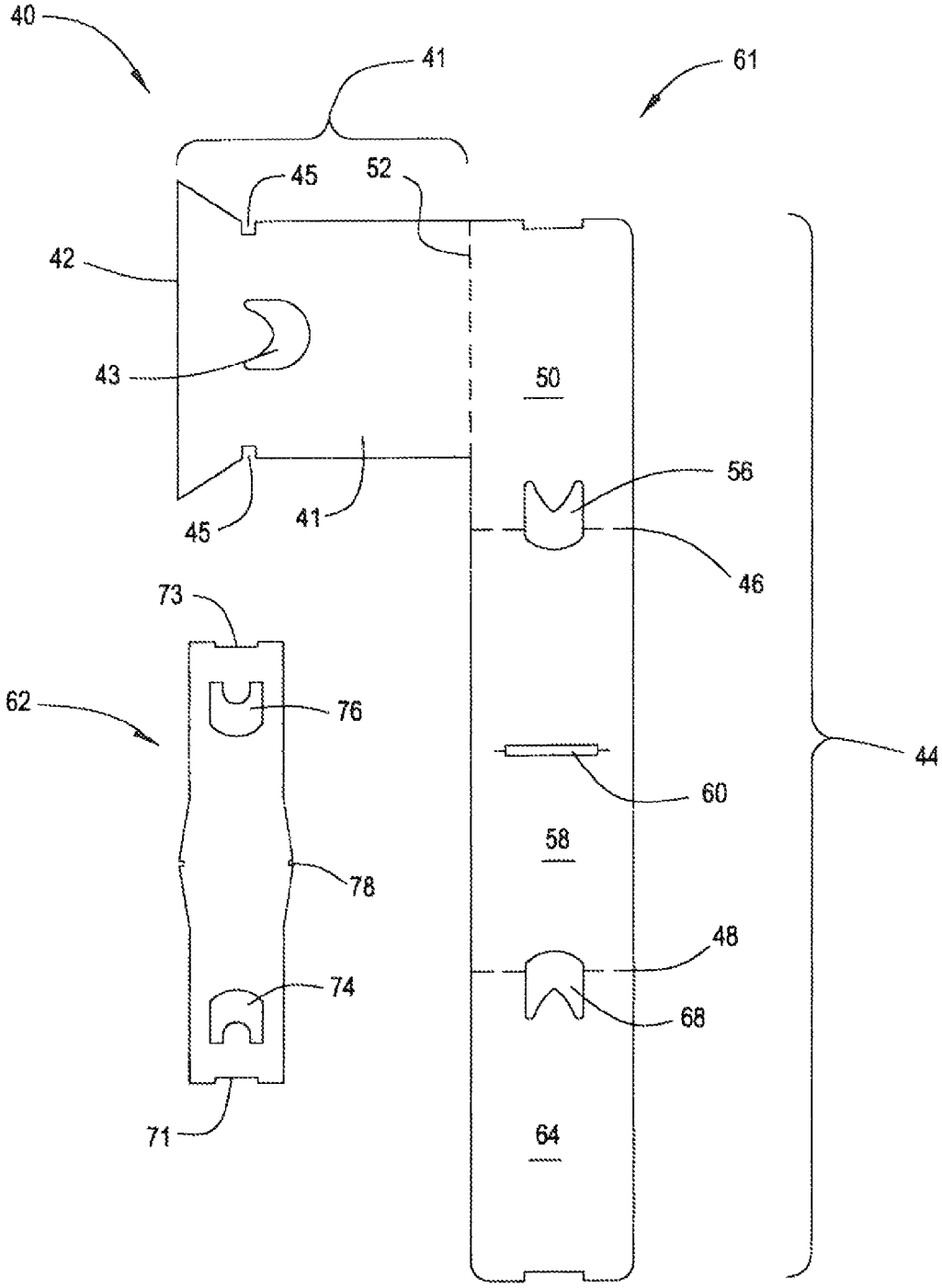
FIG. 4 shows a plan view of a foldable central member according to embodiments of the invention.

Turning now to FIG. 3, a top view of display unit 10 in the storage position is shown according to embodiments of the invention. In the storage position, the first and second display faces 22, 24 are substantially parallel with respect to each other, such that the first and second display faces 22, 24 are flattened. As will be described later herein, foldable central member 40 collapses between first and second display faces 22, 24. In this flattened, storage position, display unit 10 may be efficiently and securely shipped.

Figure 5:
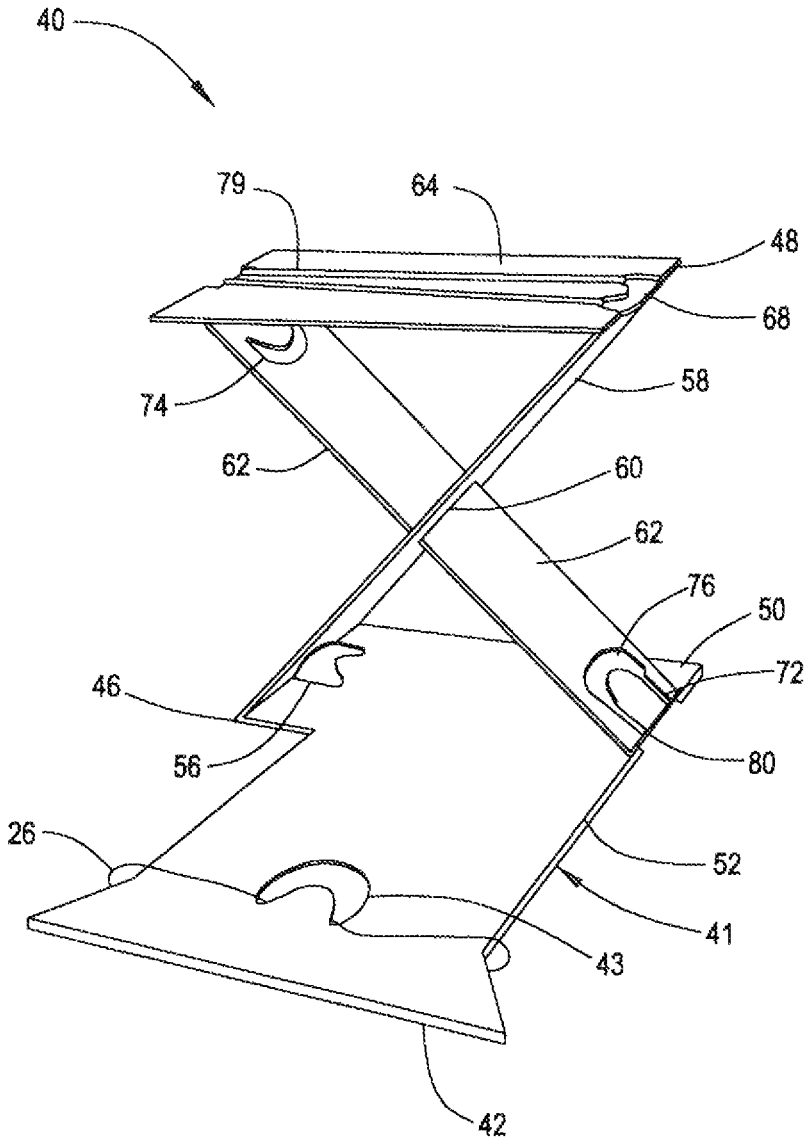
FIG. 5 shows a perspective view of a foldable central member according to embodiments of the invention.

Turning now to FIG. 4, a plan view of an unassembled foldable central member 40 according to embodiments of the invention is shown. FIG. 5 shows a perspective view of an assembled and expanded foldable central member 40 according to embodiments of the invention. As seen in FIG. 4, foldable central member 40 includes a foldable L-shaped member 61 and a transverse member 62. When connected to form display unit 10, transverse member 62 is positioned within a slot 60 of foldable L-shaped member 61. FIG. 4 shows foldable L-shaped member 61 and transverse member 62 unassembled. FIG. 5 shows foldable L-shaped member 61 and transverse member 62 assembled to form foldable central member 40 in the display position.

Referring to FIG. 4, foldable L-shaped member 61 includes a first portion 41 and a second portion 44, separated by a foldable score line 52. First portion 41 of L-shaped member 61 is used to flexibly connect foldable central member 40 to first and second display faces 22, 24 (FIG. 1). As mentioned herein, elastic bands 26, 28 are used to connect first and second display faces 22, 24. As seen in FIGS. 1 and 5, one of elastic bands 26, 28, for example, as seen in FIG. 1, elastic band 26, hooks onto hook opening 43 of the first portion 41, such that edge 42 of first portion 41 is pulled into end 30 (as shown in FIG. 1) or end 32 of display unit 10.

Second portion 44 includes a first, second, and third section 50, 58, 64, respectively. First and second section 50, 58 are separated by a score line 46 and second and third section 58, 64 are separated by a score line 48. Score lines 46, 48 allow second portion 44 of foldable L-shaped member 61 to be folded to form a Z-shape (FIG. 5). Transverse member 62 is positioned within slot 60 of foldable L-shaped member 61 (in second portion 58), so that foldable L-shaped member 61 and transverse member 62 form an X-shaped insert in the display position (FIG. 5). That is, second section 58 of foldable L-shaped member 61 is transverse with transverse member 62 in the display position. The angle between transverse member 62 and second section 58 will vary depending on the display unit 10. As best seen in FIG. 5, in the display position, the width of the foldable central member 40 is the width of each of first second 50 and third section 64.

Foldable L-shaped member 61 and transverse member 62 are flexibly connected. As seen best in FIG. 4, foldable L-shaped member 61 and transverse member 62 each include a plurality of hook openings 43, 56, 68, 74, 76. As described earlier herein, hook opening 43 of the first portion 41 is used to connect foldable central member 40 to first and second display faces 22, 24.

Referring to both FIGS. 4 and 5, transverse member 62 is positioned within slot 60 of L-shaped member 61, and second portion 44 is folded (along score lines 46, 48) to form a Z-shape. Slots 78 in transverse member 62 may be employed to prevent transverse member 62 from unwanted movement out of slot 60 of L-shaped member 61. Elastic bands 79 and 80 are used to flexibly connect L-shaped member 61 and transverse member 62. More particularly, elastic band 79 is hooked to hook opening 68 of L-shaped member 61 at one end and then hooked to hook opening 74 of transverse member 62 at the other end. Further, elastic band 80 is hooked to hook opening 56 of the L-shaped member 61 at one end and then hooked to hook opening 76 of transverse member 62 at the other end. As best seen in FIG. 4, a plurality of notches 54, 66, 71, 73 are provided on both L-shaped member 61 and transverse member 62 to properly line up elastic bands 79, 80 to connect L-shaped member 61 and transverse member 62.

Figure 7:
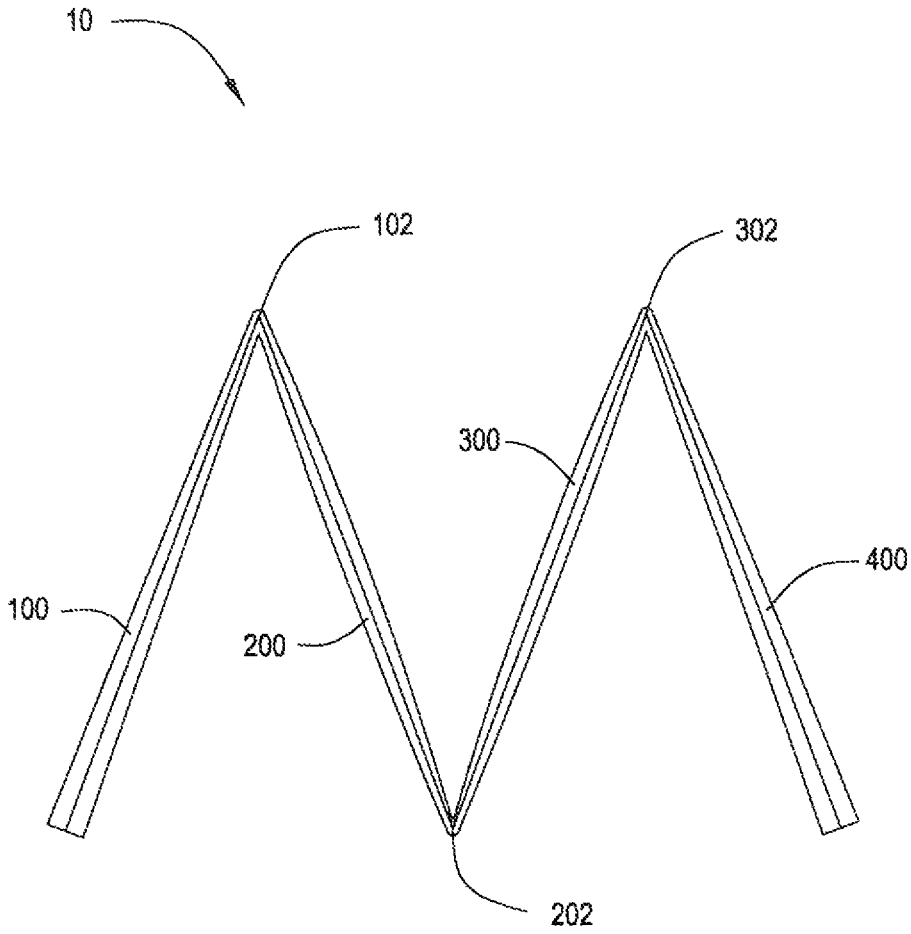
FIG. 7 shows a side view of a display unit according to embodiments of the invention.

In the storage position, the X-shaped insert (foldable L-shaped member 61 and transverse member 62) collapses, such that transverse member 62 is substantially parallel with first, second, and third sections 50, 58, 64 of the second portion 44 (FIG. 3). As mentioned above, the first and second display faces 22, 24, in the storage position, are substantially parallel (FIG. 3). As mentioned above, in the display position, the width of the foldable central member 40 is the width of each of first second 50 and third section 64. In the storage position, the width of the foldable central member 40 is the width of transverse member 62. However, it is understood that the width of the foldable central member 40, in the storage position, is never greater than the width of each of the sections 100, 200, 300, 400 (FIG. 7).

When first and second display faces 22, 24 are pressed together (e.g., with a force that is perpendicular to the surface of one of the display faces 22, 24), such that the display unit 10 becomes flat in the storage position (for shipping and/or storage purposes), the elastic bands 79, 80 stretch and allow the X-shaped foldable central member 40 to collapse between the first and second display faces 22, 24. When the display unit 10 is unpacked, or when the perpendicular force is no longer applied to the surface of one of the display faces 22, 24, the elastic bands 79, 80 will automatically contract, and force the collapsed foldable central member 40 to form an X-shape (FIG. 5), pushing display faces 22, 24 to the display position.

Figure 6:
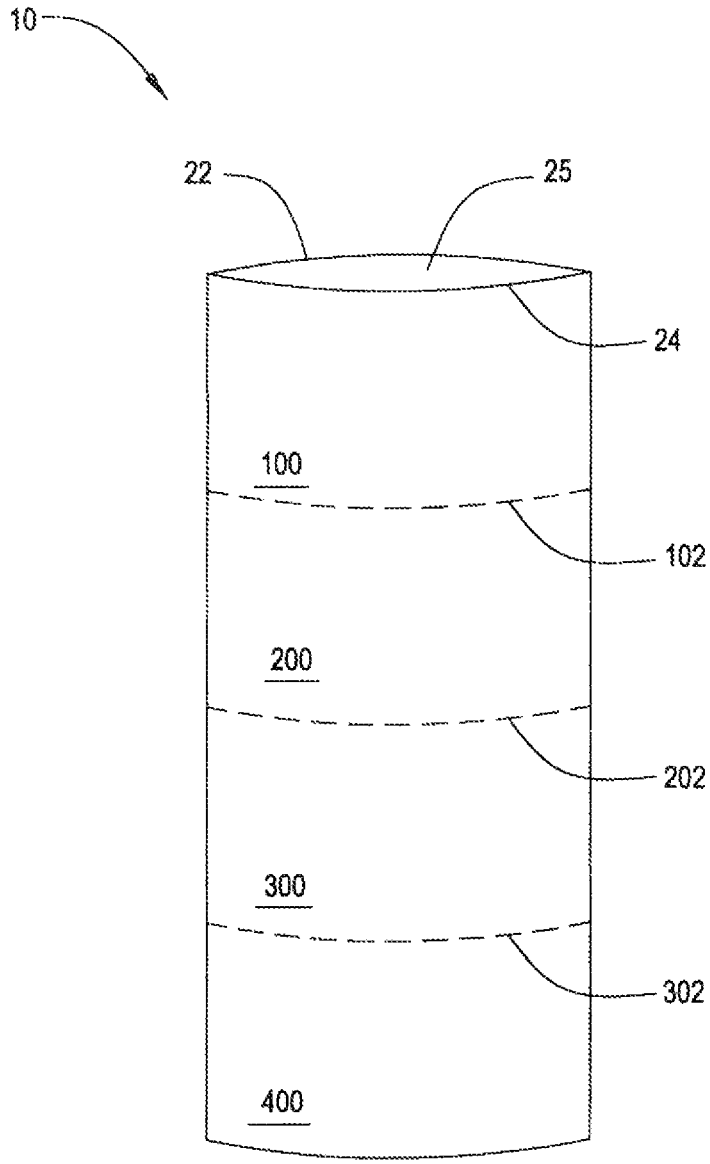
FIG. 6 shows a side view of a display unit according to embodiments of the invention.

Turning to FIG. 6, a side view of a display unit 10 is shown according to embodiments of the invention. In this embodiment, display unit 10 is shown in the display position, such that opening 25 is between first and second display faces 22, 24. Display unit 10 may include a plurality of scored lines 102, 202, 302 that separate a plurality of sections 100, 200, 300, 400, respectively. Although only three scored lines 102, 202, 302 and four sections 100, 200, 300, 400 are shown, it is understood that display unit 10 may include any number of scored lines and any number of sections.

FIGS. 1-5 show display unit 10 only including one foldable central member 40, however, it is understood that display unit may include a plurality of foldable central members 40. That is, referring to FIG. 6, display unit 10 may include, for example, a first foldable central member 40 (not shown)

between first and second display faces 22, 24 at section 200 and a second foldable central member 40 (not shown) between first and second display faces 22, 24 at section 300. In this embodiment, section 100 and section 400 of display unit may not include a foldable central member 40 between first and second display faces 22, 24. Turning to FIG. 7, a side view of the display unit 10 of FIG. 6, in the storage position, is shown according to embodiments of the invention. As shown, in the storage position, display unit 10 may further be folded along scored lines 102, 202, 302.

First and second display faces 22, 24 may include any now known or later developed paper board material, such as, but not limited to solid bleach sulfate (SBS) paperboard. The central member 40 may include any now known or later developed corrugated fiberboard. The corrugated fiberboard of the central member 40 may include any flute size, such as, but not limited to "B". Further, elastic bands 26, 28, 79, 80 may any now known or later developed flexible material, including, but not limited to, 99% natural latex.

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A display unit, comprising:

a first display face;

a second display face; and a foldable central member positioned between the first and second display faces, the foldable central member including:

a planar foldable L-shaped member; and a transverse member positioned within a slot of the planar foldable L-shaped member, wherein the foldable central member expands from a storage position to a display position, such that, in the display position, the planar foldable L-shaped member and the transverse member form a X-shaped insert, and the first and second display faces form an opening therebetween.

2. The display unit of claim 1, wherein the planar foldable L-shaped member includes a first portion and a second portion, the second portion forming a Z-shaped structure in the display position.

3. The display unit of claim 2, wherein the Z-shaped structure includes a first, second, and third section, such that the second section is transverse with the transverse member to form the X-shaped insert in the display position, and the Z-shaped structure of the planar foldable L-shaped member and the transverse member form the X-shaped insert in the display position.

4. The display unit of claim 3, wherein the X-shaped insert collapses in the storage position, such that the transverse member is substantially parallel with the first, second, and third section of the Z-shaped structure.

5. The display unit of claim 4, wherein the X-shaped insert collapses in the storage position, such that the first and second display faces are substantially parallel.

6. The display unit of claim 3, wherein the planar foldable L-shaped member and the transverse member are flexibly connected.

7. The display unit of claim 6, wherein the planar foldable L-shaped member and the transverse member each include a plurality of hook openings for receiving at least one elastic member to flexibly connect the planar foldable L-shaped member and the transverse member.

8. The display unit of claim 7, wherein the planar foldable L-shaped member and the transverse member are flexibly connected by a plurality of elastic bands.

9. The display unit of claim 8, wherein an end of each of the plurality of elastic bands are hooked into a respective hook opening of the plurality of hook openings.

10. The display unit of claim 2, wherein the first and second display faces include a plurality of openings for receiving at least one elastic member for flexibly connect the first and second display faces to a hook opening of the first portion of the planar foldable L-shaped member.

11. The display unit of claim 1, wherein the first and second display faces are divided into a plurality of sections, and the foldable central member comprises a plurality of foldable central members, with one of the plurality of foldable central members positioned in each one of the plurality of sections between the first and second display faces.

12. The display unit of claim 1, wherein the foldable central member is configured to collapse in response to a force on at least one of the first and second display faces that is substantially perpendicular to a surface of the at least one of the first and second display faces, from the display position to the storage position, such that the first and second display faces are substantially parallel in the storage position.

* * * * *